United States Patent [19]

Holik et al.

[11] Patent Number: 4,551,204

[45] Date of Patent: Nov. 5, 1985

[54] HEADBOX FOR A PAPERMAKING MACHINE

[75] Inventors: Herbert Holik, Ravensburg; Rüdiger Kurtz, Immenstaad, both of Fed. Rep. of Germany

[73] Assignee: Sulzer Brothers Ltd., Winterthur, Switzerland

[21] Appl. No.: 617,180

[22] Filed: Jun. 4, 1984

[30] Foreign Application Priority Data

Jun. 9, 1983 [CH] Switzerland ..... 3157/83

[51] Int. Cl.[4] ..... D21F 1/00

[52] U.S. Cl. ..... 162/336; 162/347

[58] Field of Search ..... 162/336, 338, 343, 344, 162/345, 347

[56] References Cited

U.S. PATENT DOCUMENTS

| | | | |
|---|---|---|---|
| 2,162,097 | 6/1939 | Metcalf | 92/43 |
| 2,934,140 | 4/1960 | Goodwillie | 162/317 |
| 3,215,593 | 11/1965 | Green | 162/347 |
| 3,321,360 | 5/1967 | Holt | 162/347 |
| 3,556,935 | 1/1971 | Amneus et al. | 162/214 |
| 3,853,695 | 12/1974 | Back et al. | 162/347 |
| 3,944,465 | 3/1976 | Wolf | 162/347 |
| 3,997,390 | 12/1976 | Kankaanpaa | 162/347 |
| 4,154,649 | 5/1979 | Stotz et al. | 162/347 |
| 4,414,062 | 11/1983 | Kirjavainen | 162/347 |

FOREIGN PATENT DOCUMENTS

| | | | |
|---|---|---|---|
| 1461076 | 1/1969 | Fed. Rep. of Germany . | |
| 2343538 | 4/1974 | Fed. Rep. of Germany . | |
| 957754 | 12/1947 | France . | |
| 697321 | 9/1953 | United Kingdom | 162/347 |

OTHER PUBLICATIONS

Escher Wyss, "Stoffauflauf" (Stufendiffusor-Stoffauflauf für Langsieb-Papiermaschinen).

*Primary Examiner*—William F. Smith
*Assistant Examiner*—Andrew J. Anderson
*Attorney, Agent, or Firm*—Werner W. Kleeman

[57] ABSTRACT

The headbox contains a nozzle channel merging at a distributor device for the fiber stock suspension. The nozzle channel contains two lip members bounding a slice opening for forming a substantially flat stock jet. At least one of these lip members is subdivided into at least two lip portions which extend over longitudinal sections of the nozzle channel which are located behind one another in the flow direction of the fiber stock suspension and which are adjustably connected with one another and can be fixed in their adjusted position. At least one of these lip portions is adjustable relative to the distributor device and the neighboring lip portion of the same lip member essentially transversely to the stock flow direction towards and away from the oppositely located lip member, in order to change the pattern or course of the cross-sectional area of the nozzle channel. This enables accommodation of the geometry of the nozzle channel to different products and production requirements.

12 Claims, 8 Drawing Figures

HEADBOX FOR A PAPERMAKING MACHINE

BACKGROUND OF THE INVENTION

The present invention broadly relates to the papermaking art, and, in particular, concerns a new and improved construction of a headbox for a papermaking machine.

Generally speaking, the headbox of the present development is of the type comprising a distributor device rheologically connected with an infeed line or conduit for a fiber stock suspension and a nozzle channel merging with and rheologically connected to such distributor device in the flow direction of the fiber stock suspension. The nozzle channel is formed between two lip members extending over a predetermined working or operating width of the headbox. These lip members bound a slice opening or outlet gap for forming a substantially flat or areal fiber stock jet. At least one of both lip members is movably connected with the distributor device and is operatively coupled with an adjustment device, by means of which there can be adjusted the flow downstream located end section of this lip member in the sense of an adjustment of its spacing from the oppositely located lip member, and such positionally adjusted lip member can then be fixed in its adjusted position.

With a known headbox of the aforementioned type, for instance as disclosed in the German Pat. No. 2,736,644, the nozzle channel is bounded by a lower lip member which is fixedly connected with the distributor device and an upper lip member which is adjustable relative to the lower lip member and can be fixed in its adjusted position. This upper lip member is constructed as a one-piece member essentially over the entire length of the nozzle channel measured in the flow direction of the stock suspension and is hingedly mounted at the region of the distributor device. At the flow downstream end of the upper lip member there is hingedly connected a pre-lip which covers the web forming zone of the papermaking machine located externally of the nozzle channel.

With this known apparatus the movable upper lip member is pivotable as a unit about its flow upstream located pivot axis by means of its adjustment mechanism. The momentary position of the flow downstream located end of this upper lip member with respect to the lower lip member governs the height of the outlet gap or slice opening. The pattern of the cross-sectional area of the nozzle channel considered in the flow direction of the stock suspension, for a given height of the slice opening, is essentially unalterable by virtue of the once selected installed position of both lip members. This can lead to difficulties in papermaking machines which should be operated, for instance, with various types of stock suspensions at different times. This is so because the nozzle channel which has been optimized for the processing of a certain quality of the fiber stock, for instance a suspension of short fiber material, generally is unsuited or only insufficiently suitable for the processing of a different quality of the fiber stock, for instance a suspension of long fiber material.

To achieve optimum operating conditions at the papermaking machine it is therefore necessary to accommodate the dimensional shape and size of the nozzle channel to the different flow velocities, the acceleration conditions with respect to the fiber orientation and/or different residence times of the stock suspensions in the nozzle channel, which must be prescribed as a function of the type of fiber stock which is momentarily being processed. With heretofore known constructions of headboxes having essentially unalterable geometry of the nozzle channel such type of accommodation of the headbox to the aforementioned parameters required relatively complicated conversion work at the headbox, resulting in correspondingly long downtimes of the papermaking machine.

SUMMARY OF THE INVENTION

Therefore, with the foregoing in mind it is a primary object of the present invention to provide a new and improved construction of a headbox for a papermaking machine which is not afflicted with the aforementioned drawbacks and limitations of the prior art constructions.

Still a further significant object of the present invention is directed to a new and improved construction of a headbox for a papermaking machine which, with a relatively modest structural design and expenditure and with less time-consuming manipulations, enables a free and widely selectable accommodation of the dimensional shape or form and/or the volume of the nozzle channel to different production and flow conditions within the limits governed by the total arrangement of the equipment and the dimensions of the papermaking machine.

Yet a further significant object of the present invention is directed to a new and improved construction of a headbox which is more versatile in its operation in that, particularly, it enables accomplishing a versatile accommodation of the configuration and effective size of the nozzle channel such as to be able to influence desired throughflow parameters of the stock suspension flowing through the nozzle channel and the manner of deposition thereof upon a forming wire of the papermaking machine.

A further significant object of the present invention is directed to a new and improved construction of a headbox for use with a papermaking machine, which headbox is relatively simple in construction and design, quite economical to manufacture, extremely reliable in operation, not readily subject to breakdown or malfunction, and requires a minimum of maintenance and servicing.

Now in order to implement these and still further objects of the invention, which will become more readily apparent as the description proceeds, the headbox construction of the present development is manifested by the features that the adjustable lip member possesses at least two lip portions arranged in succession in the flow direction of the fiber stock, and each of which lip portions extends over a respective lengthwise or longitudinal section of the nozzle channel over the working width of the headbox. These two lip portions are movably coupled with one another, and at least one of these lip portions can be positionally adjusted relative to the distributor device and to the neighboring or the at least one neighboring lip portion of the same lip member, towards and away from the oppositely located lip member, in order to be able to alter the course or pattern of the cross-section or cross-sectional area of the nozzle channel.

The subdivision of the adjustable lip member into lip portions which can be adjusted relative to one another as well as with regard to the oppositely situated or confronting lip member and also with respect to the distributor device, enables accomplishing a constriction or enlargement, as the case may be, of the nozzle channel. Consequently, there is possible an extensively free accommodation of the course or pattern of the cross-section and/or the volume of the nozzle channel to different operating conditions, without altering, for instance, the position of the flow downstream located end portion of the adjustable lip member with respect to the oppositely situated lip member. In this way, it is possible not to affect a possibly existing adjustment of the height and/or the geometry and position of the outlet gap or slice opening relative to a predetermined impact or deposition location of the fiber stock jet, and which geometry and position of the slice opening has been fixed in accordance with the relevant type of papermaking machine with which the headbox is used.

The inventive design of the headbox can be accommodated at any instance during the operation of the papermaking machine and within a brief amount of time to the most different products and production requirements, especially to different throughput quantities of the fiber stock suspension which is to be processed. This is so because, for instance, by reducing the nozzle volume, for instance when converting the headbox to handle a lower stock throughput, the mean or average flow velocity within the nozzle channel can be maintained approximately constant; with constant throughput quantity the residence time of the stock suspension in the nozzle channel is correspondingly reduced, i.e., due to the increase of the flow velocity of the stock suspension there is obtained a correspondingly more intensified turbulence of the fiber stock flow. Consequently, even if there is altered the product and production program with very little advance notice, there can be effectively prevented a deflocculation of the suspended stock fibers in the nozzle channel, and thus, there is insured for a constant fiber formation and a constant paper quality within the limits dictated by the construction of the headbox.

A particularly effective manner of influencing the course or pattern of the cross-section or cross-sectional area of the nozzle channel can be realized, according to a further embodiment of the invention, in that the moveable lip portion of the adjustable lip member is pivotably connected with the or the at least one neighboring lip portion of the same lip member. With this design it is possible to influence the acceleration behavior per unit of time by virtue of the local change of the nozzle cross-section which can be realized at the region of the connection or attachment location between both of the lip portions. Hence, there can be influenced the fiber orientation in a most simple manner, and thus, the lengthwise or longitudinal strength of the paper which is to be fabricated.

According to a particularly advantageous embodiment of the invention, at least one of the lip portions of the adjustable lip member can be displaceably connected with the or the at least one neighboring lip portion of the same lip member essentially in the direction of flow of the fiber stock suspension. Due to the provision of the mutually displaceable lip portions, there are compensated the changes in length of the adjustable lip member, which arise by altering the form and/or the volume of the nozzle channel, so that the adjustment of the moveable lip portion does not require any change in the height and the momentarily set position of the slice opening with respect to the impact location of the effluxing stock suspension jet which has been set in the papermaking machine.

According to a further design, it is possible to obtain a particularly flow favorable, essentially step-less or infinitely adjustable change in the course or pattern of the cross-section of such nozzle channel at the relevant portion thereof in that, at least one of the lip portions of the adjustable lip member possesses a wall element which is elastically deformable in a direction transverse to the flow direction of the stock suspension.

According to a further construction of the invention, there can be realized an advantageously large adjustment range of the moveable lip portion in that, at least one of the lip portions of the adjustable lip member is displaceably coupled with the distributor device essentially in the flow direction of the stock suspension. This design, within the limits dictated by the construction of the headbox, allows for an almost random alteration of the geometry of the nozzle channel between arrangements having markedly converging lip portions or sections and those having essentially parallelly extending lip portions or sections throughout almost the entire length of the nozzle channel. Depending upon the construction it is possible to adjust the spacing between the mutually oppositely situated, parallel extending lip members or lip portions, for instance to values which lie between the dimension of the outlet cross-section of the distributor device measured transverse to the flow direction of the stock suspension and the height of the slice opening or outlet gap.

With one design of the headbox according to the invention, which contains a stationarily arranged lip portion of the other lip member which is located opposite the moveable lip portion, it is possible to influence the relative position of the mutually oppositely situated lip members rapidly and in a particularly simple fashion in that, the distributor device is pivotably connected with the stationary lip portion. In corresponding manner the distributor device can be positionally adjusted, for instance between a first position where the stock suspension flows therethrough essentially parallel to the stationary lip member, and a second position in which such distributor device has the stock suspension flowing therethrough at such an obtuse angle that, both of the lip members which are located mutually opposite one another and merge at the distributor device extend essentially mutually parallel to one another from the outlet cross-section of the distributor device to the slice opening or outlet gap. This design allows the papermaking machine to be operated at low jet velocities and correspondingly low production velocities, since the height of the liquid column, governed by the structural height of the nozzle channel and effective for the outlet velocity of the fiber stock jet, can be reduced to a minimum, for instance to the height of the outlet gap or slice opening, and thus, there can be produced a purely slot-like flow in the nozzle channel.

BRIEF DESCRIPTION OF THE DRAWINGS

The invention will be better understood and objects other than those set forth above, will become apparent when consideration is given to the following detailed description thereof. Such description makes reference to the annexed drawings wherein throughout the various figures of the drawings there have been generally used the same reference characters to denote the same or analogous components and wherein.

DETAILED DESCRIPTION OF THE PREFERRED EMBODIMENTS

Figure 1:
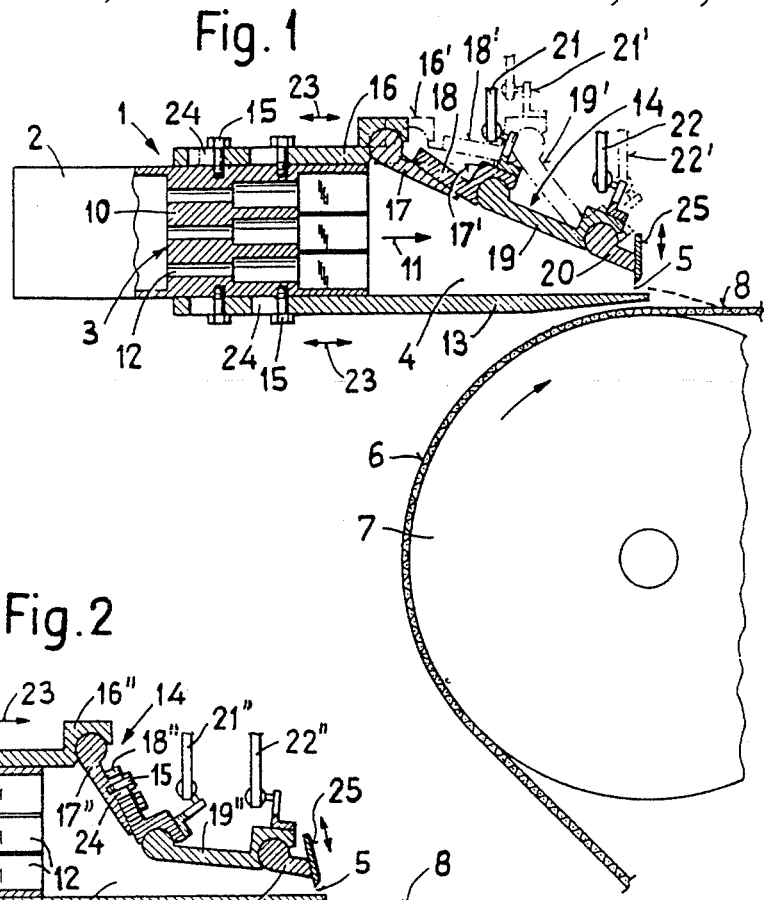
FIG. 1 illustrates part of a papermaking machine equipped with a first exemplary embodiment of headbox, shown in partial sectional view, and constructed according to the present invention.

Describing now the drawings, it is to be understood that only enough of the construction of the different exemplary embodiments of headboxes and related papermaking machine have been conveniently shown in the drawings to simplify the illustration, while enabling those skilled in the art to readily understand the underlying principles and concepts of the present development. Turning attention now to the exemplary embodiment of headbox 1 illustrated in FIG. 1, it will be seen that such contains a distributor device or stock guide means 3 connected with an infeed line or conduit 2 for a stock suspension. The headbox 1 further contains a nozzle channel 4 which merges with the distributor device 3. This nozzle channel 4 converges towards the slice opening or outlet gap 5 which extends perpendicular to the plane of the drawing over a given work or operating width of the headbox and serves for the formation of a substantially flat fiber stock jet. This fiber stock jet constitutes a free jet which affords the advantage that the fibers contained therein are deposited essentially in the position that they efflux through the slice opening 5 onto the endless longitudinal wire or sieve 6 of the papermaking machine. In particular, it will be observed that the nozzle channel 4 together with the slice opening or outlet gap 5 are directed towards such endless longitudinal wire 6 of the papermaking machine 5, and which longitudinal wire 6 has only been partially illustrated in the showing of FIG. 1 but is of conventional design. Furthermore, this longitudinal or forming wire 6 is trained about a breast roll 7 and thereafter is guided through a dewatering region or zone 8 and thereafter to further, not particularly illustrated but conventional, work regions of the longitudinal wire-papermaking machine.

The distributor device or guide means 3 contains a distributor block 10 in which there are provided stock throughflow channels 12 which open into the nozzle channel 4. The nozzle channel 4 is bounded or delimited by a lower lip member or lip 13 which is essentially stationarily arranged with respect to the longitudinal wire 6 and an upper lip member or lip 14 which is moveable relative to the lower lip member 13. This lower lip member 13, as shown in the arrangement of FIG. 1, can be designed as a one-piece or integral lip structure and can be appropriately connected, for instance by threaded bolts or screws 15 with the distributor block 10. The upper lip member or lip 14 is subdivided into a plurality of lip portions or sections 16, 17, 18, 19 and 20 which follow one another in the direction of the stock flow, as generally indicated by the arrow 11. The upper lip member 14, composed of the plural lip portions or sections 16, 17, 18, 19 and 20, is operatively coupled with two adjustment devices 21 and 22 which are connected with conventional and therefore not particularly illustrated support elements or components of the papermaking machine. By means of these adjustment or setting devices 21 and 22, it is possible to positionally adjust and fix in the adjusted position the upper lip member 14 with respect to both the distributor device 3 and the lower lip member 13.

The lip portion or section 16 is displaceably connected, as indicated by the double-headed arrow 23, with the stock distributor device 3. As shown in FIG. 1, the lip portion or section 16 can be provided, for instance, with appropriate elongate holes or openings 24 for the threaded bolts 15, which enables such lip portion 16 to be positionally adjusted between the position depicted in full or solid lines and a position, as indicated for instance by reference character 16′ which has been depicted in phantom or broken lines. Equally, the lower lip member 13 can be provided with elongate or longitudinally extending holes 24 and can be adjusted in accordance with the double-headed arrow 23 for the purpose of adjusting the impact or deposition location of the fiber stock jet effluxing out of the slice opening 5 onto the longitudinal or forming wire 6. The distributor device 3 together with the upper lip member 14 can be correspondingly adjusted in relation to the fixedly adjusted lower lip member 13.

Figure 2:
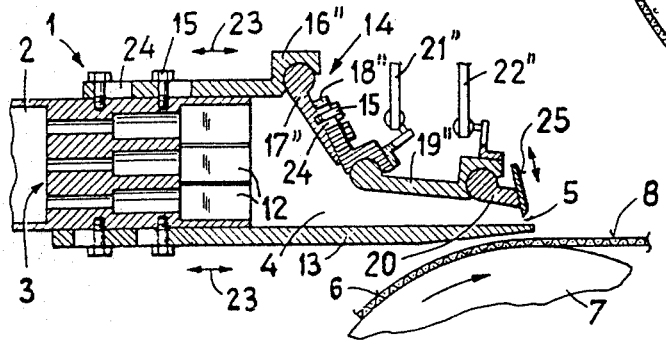
FIG. 2 illustrates the headbox of FIG. 1 adjusted into a different operating position.
Figure 3:
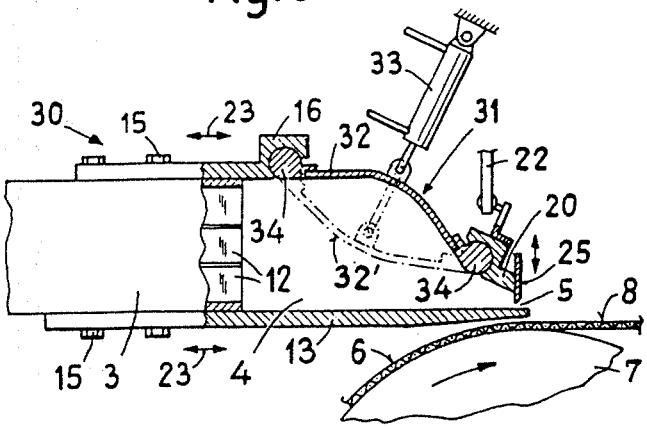
FIGS. 3, 4, 5, 6, 7 and 8 illustrate still further respective constructions of headboxes in corresponding partial sectional views.

The lip portion or section 17 is pivotably connected with the lip portion 16 and is displaceably and positionally fixably adjustably connected with the flow-downstream neighboring lip portion 18 in conventional fashion by means of attachment or connection means in the flow direction of the stock suspension. The lip portion or section 17 in FIG. 1, respctively 17″ in FIG. 2, and the lip portion or section 18 in FIG. 1, respectively 18″ in FIG. 2, are both provided with mutually cooperating and complementary substantially smooth and planar contact surfaces. The lip portion or section 18, respectively 18″, is provided with elongate holes or slots 24 through which extend releasable clamping or connector members such as threaded members or screws 15. The two lip portions or sections 17 and 18, respectively 17″ and 18″, can thus be slidably adjusted in relation to one another and fixed in a desired mutual spatial relationship.

The lip portion 18, in turn, is pivotably connected with the flow-downstream neighboring lip portion 19 at which there is pivotably connected the flow-downstream located last lip portion or section 20. At the free end of the lip portion 20 there can be mounted in known fashion an adjustable diaphragm or closure 25 for accomplishing a fine adjustment of the slice opening or outlet gap 5. This adjustable diaphragm 25 can be positionally adjusted, in the direction of the not particularly referenced double-headed arrow located there adjacent, such that for certain application there can be obtained a very sudden or rapid acceleration of the effluxing fiber stock suspension, so that the fibers will tend to become more aligned in the lengthwise direction. Such is particularly advantageous for the fabrication of certain types of paper qualities.

The upper lip member 14 can be adjusted relative to the lower lip member 13 and the distributor device 3 by means of the adjustment devices 21 and 22 connected with the lip portions or sections 18 and 19, within the limits governed by the constructional design of the coacting components. In this regard it will be observed that, for instance, the lip portion 20 can be held in a fixed predetermined unaltered position relative to the lower lip member 13, as shown in solid or full lines in FIGS. 1 and 2, in accordance with the height of the outlet gap 5 and the direction of the fiber stock jet, whereas the lip portions 16, 17, 18, 19 and the adjustment devices 21, 22 can be adjusted in each case out of their positions shown in FIG. 1 with solid lines into the phantom line depicted positions 16', 17', 18', 19' and 21', 22', respectively, and even beyond such positions, or into the positions 16'', 17'', 18'', 19'' and 21'', 22'', respectively, depicted in FIG. 2 and beyond such positions. The length changes thus arising at the lip member 14, and which are required for such adjustments, are taken-up in each case by appropriate mutual displacement of the lip portions 17 and 18 and/or by appropiate displacement of the lip portion 16 relative to the distributor device 3. By virtue of the previously described construction of the upper lip member 14, it is thus possible to randomly alter, within wide limits, the dimensional shape or form and/or the volume of the nozzle channel 4 and to accommodate such to varying operating conditions, independent of the momentarily set or adjusted geometry and orientation of the outlet gap or slice opening 5. To obtain an even finer adjustment of the effluxing fiber stock jet it is possible to appropriately positionally adjust the moveable diaphragm 25.

Continuing, it will be understood that in the further FIGS. 3 to 8 of the drawings there have been generally used throughout the various embodiments the same reference characters to denote the same or analogous components as for the headbox 1 described with reference to FIGS. 1 and 2. The further exemplary embodiment of headbox 30 depicted in FIG. 3 will be seen to contain an upper lip member 31 having an elastically deformable wall element 32. This elastically deformable wall element 32 can comprise a flexible plate formed of, for instance, steel sheeting, plastic or rubber, and two holder parts or members 34 connected therewith, by means of which such plate is pivotably connected at the flow-upstream neighboring lip portion 16 and at the flow-downstream last lip portion 20, respectively. It will be observed that the lip portion or section 20 is connected with the adjustment device 22. The wall element 32 is operatively coupled with an adjustment device 33, which in the illustrated exemplary embodiment has been depicted as a piston-and-cylinder unit. By means of this adjustment device 33 it is possible to infinitely adjust the wall element 32 between the position shown in solid or full lines in FIG. 3 and the broken or phantom line position 32'. Also this exemplary embodiment of headbox 30 affords a particularly effective and flow-favorable accommodation of the geometry of the upper lip member 31 to varying operating and/or flow conditions.

Figure 4:
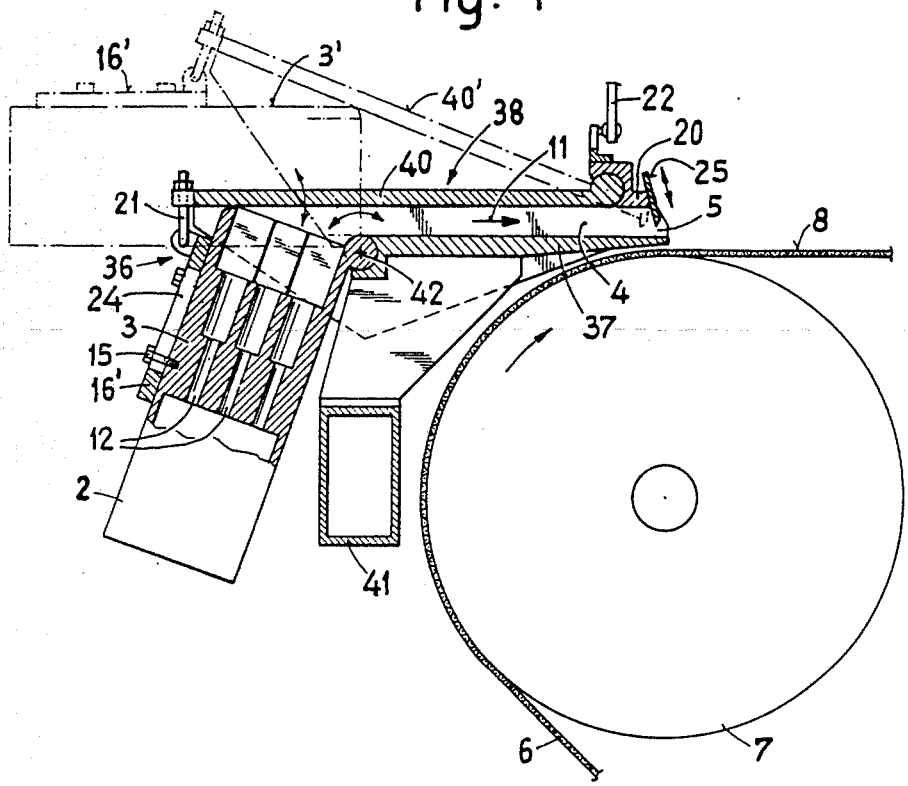

The exemplary embodiment of headbox 36 depicted in FIG. 4 will be seen to contain a lower lip member or lip 37 which is pivotably connected with the distributor device 3 and an upper lip member or lip 38 which possesses a lip portion or section 40 which is pivotably connected with the last flow-downstream located lip portion 20, and which is displaceably connected with the distributor device 3 in the flow direction of the fiber stock suspension. The stock distributor device 3 is provided with a displaceably adjustable member 16' carrying journal means for rotatably engaging a connector element 21 provided on the upper lip portion or section 40. The displaceably adjustable member 16' is provided with elongate holes or slots 24 for accommodating releasable clamping or connector members, such as threaded members or screws 15. This construction permits angular displacement or adjustment of the stock distributor device 3 and of the upper lip portion or section 40 in relation to the lower lip member 37.

The lower lip member 37 is fixedly arranged upon a support or carrier 41 of the papermaking machine. In accordance with the illustration of FIG. 4, the entire distributor device 3 can be hingedly connected, about a pivot shaft 42, with the lower lip member 37. This pivotably mounted distributor device 37 therefore can be selectively adjusted between the position shown in full or solid lines, in which the lengthwise axes of the channels 12 are disposed at an obtuse angle with respect to the inner surface of the lower lip member 37, and the position 3' depicted in phantom lines in which the lengthwise axes of the channels 12 extend approximately parallel to the inner wall or surface of the lower lip member 37. In corresponding fashion the lip portion 40 which is hingedly connected with the lip portion 20 can be positionally adjusted between the illustrated full line position, in which its inner surface extends approximately parallel to the inner surface of the lower lip member 37, and the phantom line depicted position 40' in which the lip portion 40 in conjunction with the lip member 37 converges towards the slice opening or outlet gap 5. With appropriate angle of inclination of the stock distributor device 3 with respect to the inner wall of the lower lip member 37 it is possible to reduce the spacing between the lip members 37 and 38 to a minimum, for instance to the height of the slice opening 5. Consequently, there can be formed a slot-like flow within the nozzle channel 4 which, by virtue of the effective liquid column which is reduced to a minimum height, renders possible operation of the headbox with particularly lower outlet velocity of the stock jet and with a correspondingly reduced production velocity of the papermaking machine.

Figure 5:
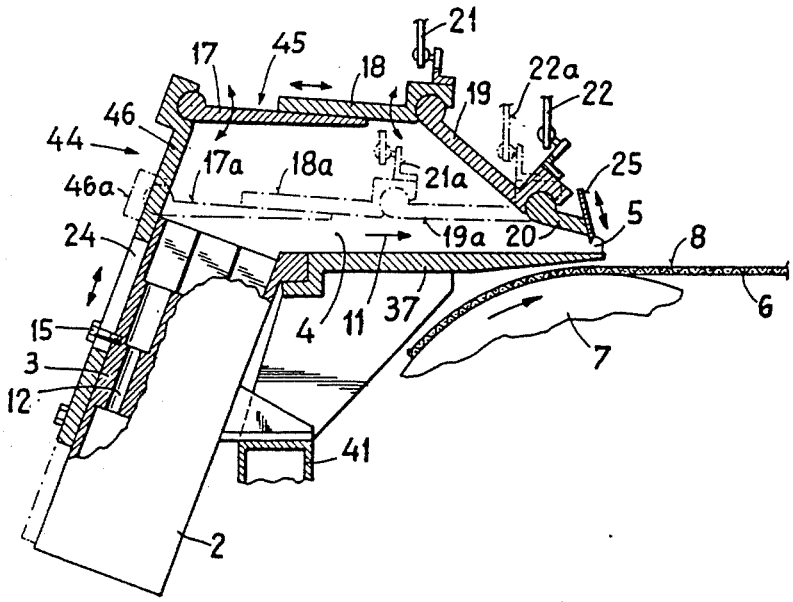

With the construction of headbox 44 depicted in FIG. 5 the distributor device 3 is likewise arranged at an inclination with respect to the lower lip member 37. However, in this case the distributor device 3 is fixedly connected both with the lower lip member 37 as well as with the support or carrier 41. The headbox 44 contains an upper lip member 45 composed of the lip portions or sections 17, 18, 19, 20 and a lip portion or section 46. This lip portion 46 is pivotably connected with the lip portion 17 and is displaceably secured at the distributor device 3 for movement parallel to the lengthwise axes of the channels 12. This lip portion 46 can be selectively displaced between the position shown in full or solid lines in which the spacing of the hinge location of the lip portion 17 from the lower lip member 37 approximately corresponds to the dimension of the outlet cross-section of the distributor device 3 measured in the plane of the drawing, and the phantom line position **46*a* in which the hinge or pivot location is located at the region of the distributor device 3. In corresponding manner the lip portions 16, 17, 18, 19 and the adjustment devices 21, 22 can be adjustably positioned to assume the phantom line depicted positions 17*a*, 18*a*, 19*a* and 21*a*, 22*a*, respectively, so that the lip portions 17, 18, 19 and 20 extend essentially parallel to the lower lip member 37 or converge toward such lower lip member 37 in the direction of the slice opening or outlet gap 5**.

Figure 6:
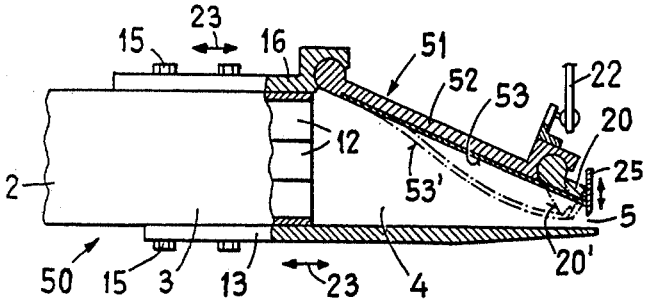

The modified construction of headbox 50 depicted in FIG. 6 also can possess a lip member 51 composed of a rigid lip portion 52 which is moveably connected with the lip portions 16 and 20 and furthermore has an elastically deformable adjustment plate or plate member 53 which is arranged at the inner side or surface of the lip portion 52 and extends over the entire working width of the headbox 50. This adjustment or adjustable plate 53, which is formed for instance of steel plating, can be secured at its flow-upstream located marginal portion at the lip portion 52 and by means of its flow-downstream marginal portion at the lip portion 20 such that when the inner surfaces of the lip portions 52 and 20 are located in a single plane such adjustable plate 53 contactingly bears against such lip portions 52 and 20. On the other hand, when the lip portion 20 assumes an angled position 20' in relation to the lip portion 52 in the sense of constricting the nozzle channel 4, then the adjustment or adjustable plate 53 is elastically deformed and assumes the phantom line position 53'. This embodiment renders possible a particularly flow-favorable arrangement which, in a very simple fashion, enables effectively influencing the flow conditions within the nozzle channel 4. The adjustment of the height and the position of the slice opening or outlet gap 5, which is possible with this exemplary embodiment, can be corrected by appropriately displacing the lip portion 16 in the direction of the double-headed arrow 23 and/or by an appropriate adjustment or setting of the diaphragm 25. With this construction of headbox there is afforded an extremely fine adjustment of the flow conditions within the nozzle channel 4 and at the outlet slice 5 by virtue of the various adjustment facilities which are here provided.

Figure 7:
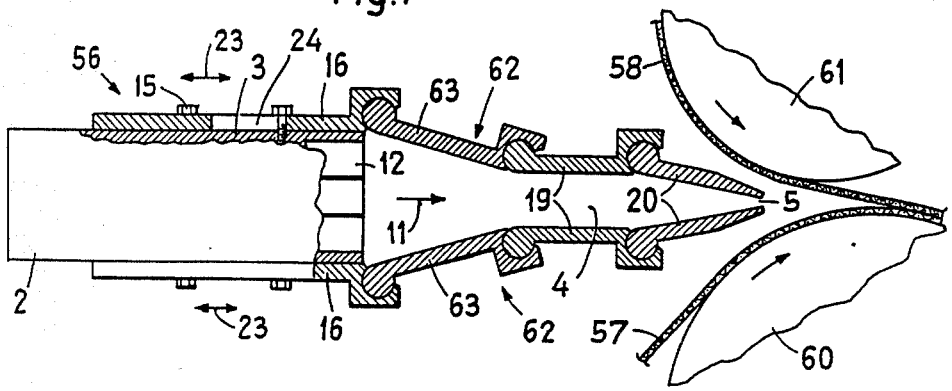

The headbox 56 depicted in FIG. 7 is shown directed between two dewatering wires or sieves 57 and 58 of a twin-wire papermaking machine. Each of these dewatering wires or sieves 57 and 58 are trained about a respective guide roll 60 and 61 of the here not further shown twin-wire papermaking machine, and these two dewatering wires 57 and 58 are convergingly guided together to form an inlet gap for the fiber stock jet which effluxes through the slice opening or outlet gap 5 of the headbox 56. This headbox 56 contains two lip members 62 which are symmetrically arranged in the illustrated position. Each of these lip members or lips 62 contains the lip portions or sections 16, 19 and 20 as well as a respective further lip portion 63 which is articulated to the displaceable lip portion 16 and is pivotably connected with the neighboring lip portion 19. The lip portions or sections 63, 19 and 20 of each lip member 62 are positionally adjustable by means of conventional and therefore not particularly here illustrated adjustment devices in the already described manner in the sense of altering the course or pattern of the cross-section or cross-sectional area of the nozzle channel 4 relative to the distributor device 3 and with respect to the other lip member 62. The relative movements of the lip portions 19, 20 and 63 parallel to the flow direction, generally indicated by the arrow 11, which arises in each case during the pivoting motion, can be compensated by appropriately displacing the lip portion 16 in the direction of the arrow 23. In this way there can be achieved and maintained a once-set position of the slice opening 5 with respect to the distributor device 3 independent of the adjustment of the remaining lip portions.

Figure 8:
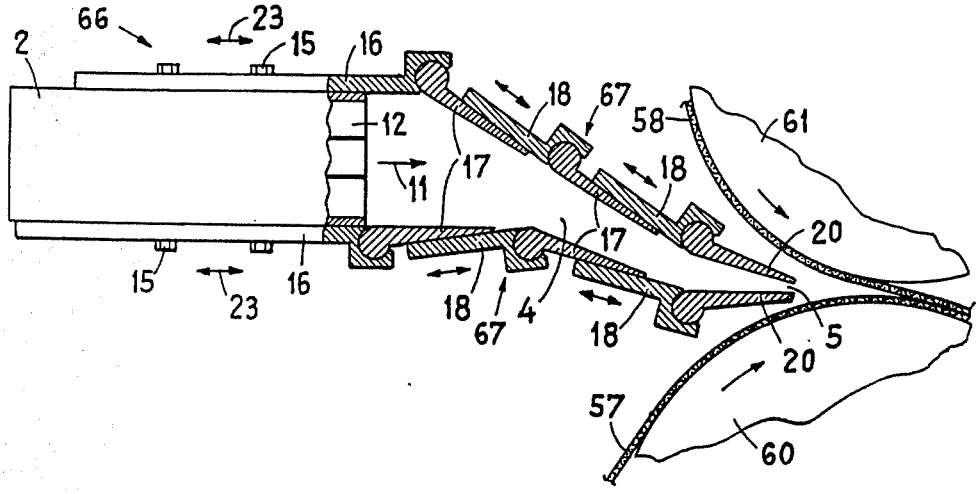

Also with the construction of headbox 66 depicted in FIG. 8 both of the lip members 67 are moveable in the already described manner along with the distributor device 3 and adjustably connected relative to one another. Each lip member 67 contains the lip portions 16, 17, 18 and 20. The lip portions or sections 17 and 18 which are displaceably connected with one another in the direction of the flow of the fiber stock suspension, are provided twice as illustrated. As also will be readily understood from the illustration of FIG. 8, due to this design of the headbox 66 there is obtained a particularly adaptable lip arrangement which, within the limits governed by the headbox construction, allow for an almost random adjustment of the geometry of the nozzle channel 4.

It will be understood that various other embodiments of the invention are possible, without departing from the underlying principles and concepts thereof. In particular, the inventive constructions of headboxes also are suitable for use with different constructions of distributor devices than have been shown in simplified manner in the drawings and equally are suitable for use with almost every type of papermaking machine. As a modification of the embodiment of headbox depicted in FIG. 3, there can be provided at the lip portions 16 and 20, instead of the pivotable holder elements or components 34, also for instance stationary holders for the attachment and/or moveable guiding of the flexible wall element 32. With the embodiment of FIG. 6 there can be provided an infeed of a suitable pressurized fluid medium into the space between the lip portion 52 and the adjustment or adjustable plate 53. The adjustable plate 53 also can be composed of, for instance, an appropriately deformable or, if desired, expansible plastic or rubber component.

While there are shown and described present preferred embodiments of the invention, it is to be distinctly understood that the invention is not limited thereto, but may be otherwise variously embodied and practiced within the scope of the following claims. ACCORDINGLY,

What we claim is:

1. A headbox for a papermaking machine having a predetermined operating width, comprising:

an infeed means for a fiber stock suspension;

said fiber stock suspension having a predetermined direction of flow;

a stock distributor device rheologically connected to said infeed means;

a nozzle channel rheologically connected subsequent to said stock distributor device as viewed in said predetermined direction of flow;

a first lip member and a second lip member conjointly delimiting a slice opening extending over said predetermined operating width;

said nozzle channel being formed between said first lip member and said second lip member;

at least said first lip member comprising at least two hingedly interconnected lip portions arranged successively in said predetermined direction of flow;

said second lip member defining an oppositely situated lip member confronting said first lip member;

means for adjustably fixing said at least two hingedly interconnected lip portions relative to one another in a predetermined operative position thereof in relation to at least one of said oppositely situated lip member and said stock distributor device;

at least said first lip member defining an adjustable lip member;

said adjustable lip member comprising at least one lip portion of said at least two hingedly interconnected lip portions which is displaceably connected to said stock distributor device in correspondence with said predetermined direction of flow;

said adjustable lip member comprising at least one further lip portion of said at least two hingedly interconnected lip portions which at least partially delimits said slice opening;

said at least one further lip portion having a downstream end;

said at least one further lip portion being provided at said downstream end thereof with a diaphragm adjustable in relation to said oppositely situated lip member in a direction substantially transverse to said predetermined direction of flow and adapted to form a substantially planar free jet of said fiber stock suspension;

at least one lip portion of said at least two hingedly interconnected lip portions defining an upstream lip portion situated adjacent said at least one further lip portion in an upstream direction as viewed in said predetermined direction of flow;

said at least one further lip portion and said upstream lip portion mutually defining a hinged connecting location;

said hinged connecting location being arranged in immediate proximity to said diaphragm;

adjustment means for pivotably adjusting said diaphragm about said hinged connecting location through an angle of inclination in relation to said oppositely situated lip member which is predetermined independently of the momentary position of said upstream lip portion; and said adjustment means further permitting adjusting said upstream lip portion independently of the momentary position of said diaphragm in relation to said stock distributor device.

2. The headbox as defined in claim 1, further including:

means for displaceably and fixably adjustably connecting at least one of the lip portions of the adjustable lip member with a neighboring lip portion of the same lip member for movement essentially in the direction of flow of the fiber stock suspension.

3. The headbox as defined in claim 1, further including:

means for displaceably mounting at least one of the lip portions of the adjustable lip member in relation to the distributor device essentially in the direction of flow of the fiber stock suspension.

4. The headbox as defined in claim 1, wherein the oppositely situated lip member comprises a stationarily arranged lip portion located opposite the adjustable lip member; and means for pivotably mounting the distributor device at the stationary lip portion.

5. The headbox as defined in claim 1, wherein:

said two lip members are structured such that a free fiber stock jet is delivered through said slice opening.

6. The headbox as defined in claim 1, further including:

at least two partial lip portions arranged between said at least one lip portion displaceably connected to said stock distributor device and said at least one further lip portion which at least partially delimits said slice opening;

said at least two partial lip portions being mutually displaceably and fixably adjustably coupled in said predetermined direction of flow;

said at least two partial lip portions each comprising a substantially planar sliding surface; and means for arranging said at least two partial lip portions with said substantially planar sliding surfaces in mutually overlapping contact in said predetermined direction of flow and for mutually fixably adjustably displacing said at least two partial lip portions in said predetermined direction of flow.

7. The headbox as defined in claim 1, wherein:

said adjustable lip member comprises at least one wall element elastically deformable in a direction substantially transverse to said predetermined direction of flow and arranged between said at least one lip portion connected to said stock distributor device and said at least one further lip portion provided with said diaphragm.

8. The headbox as defined in claim 1, wherein:

said first lip member comprises a movable lip portion;

said second lip member being fixedly arranged opposite said movable lip portion; and said stock distributor device being pivotably hinged to said fixedly arranged lip member.

9. The headbox as defined in claim 1, wherein:

said first lip member and said second lip member are structured such that a free fiber stock jet is delivered through said slice opening directly into the atmosphere for deposition upon a web forming wire.

10. A headbox for a papermaking machine having a predetermined operating width, comprising:

an infeed means for a fiber stock suspension;

said fiber stock suspension having a predetermined direction of flow;

a stock distributor device rheologically connected to said infeed means;

a nozzle channel rheologically connected subsequent to said stock distributor device as viewed in said predetermined direction of flow;

a first lip member and a second lip member conjointly delimiting a slice opening extending over said predetermined operating width;

said nozzle channel being formed between said first lip member and said second lip member;

at least said first lip member comprising at least two hingedly interconnected lip portions arranged successively in said predetermined direction of flow;

said second lip member defining an oppositely situated lip member confronting said first lip member;

means for adjustably fixing said at least two hingedly interconnected lip portions relative to one another in a predetermined operative position thereof in relation to at least one of said oppositely situated lip member and said stock distributor device;

at least said first lip member defining an adjustable lip member;

said adjustable lip member comprising at least one lip portion of said at least two hingedly interconnected lip portions which is displaceably connected to said stock distributor device in correspondence with said predetermined direction of flow;

said adjustable lip member comprising at least one further lip portion of said at least two hingedly interconnected lip portions which at least partially delimits said slice opening;

said at least one further lip portion having a downstream end;

said at least one further lip portion being provided at said downstream end thereof with a diaphragm adjustable in relation to said oppositely situated lip member in a direction substantially transverse to said predetermined direction of flow and adapted to form a substantially planar free jet of said fiber stock suspension;

at least one lip portion of said at least two hingedly interconnected lip portions defining an upstream lip portion situated adjacent said at least one further lip portion in an upstream direction as viewed in said predetermined direction of flow;

said at least one further lip portion and said upstream lip portion mutually defining a hinged connecting location;

said hinged connecting location being arranged in immediate proximity to said diaphragm;

adjustment means for pivotably adjusting said diaphragm about said hinged connecting location through an angle of inclination in relation to said oppositely situated lip member which is predetermined independently of the momentary position of said upstream lip portion;

said adjustment means further permitting adjusting said upstream lip portion independently of the momentary position of said diaphragm in relation to said stock distributor device;

said adjustment means comprising at least two partial lip portions arranged between said at least one lip portion displaceably connected to said stock distributor device and said at least one further lip portion which at least partially delimits said slice opening;

said at least two partial lip portions being mutually displaceably and fixably adjustably coupled in said predetermined direction of flow;

said at least two partial lip portions each comprising a substantially planar sliding surface; and means for arranging said at least two partial lip portions with said substantially planar sliding surfaces in mutually overlapping contact in said predetermined direction of flow and for mutually fixably adjustably displacing said at least two partial lip portions in said predetermined direction of flow.

11. A headbox for a papermaking machine having a predetermined operating width, comprising:

an infeed means for a fiber stock suspension;

said fiber stock suspension having a predetermined direction of flow;

a stock distributor device rheologically connected to said infeed means;

a nozzle channel rheologically connected subsequent to said stock distributor device as viewed in said predetermined direction of flow;

a first lip member and a second lip member conjointly delimiting a slice opening extending over said predetermined operating width;

said nozzle channel being formed between said first lip member and said second lip member;

at least said first lip member comprising at least two hingedly interconnected lip portions arranged successively in said predetermined direction of flow;

said second lip member defining an oppositely situated lip member confronting said first lip member;

means for adjustably fixing said at least two hingedly interconnected lip portions relative to one another in a predetermined operative position thereof in relation to at least one of said oppositely situated lip member and said stock distributor device;

at least said first lip member defining an adjustable lip member;

said adjustable lip member comprising at least one lip portion of said at least two hingedly interconnected lip portions which is displaceably connected to said stock distributor device in correspondence with said predetermined direction of flow;

said adjustable lip member comprising at least one further lip portion of said at least two hingedly interconnected lip portions which at least partially delimits said slice opening;

said at least one further lip portion having a downstream end;

said at least one further lip portion being provided at said downstream end thereof with a diaphragm adjustable in relation to said oppositely situated lip member in a direction substantially transverse to said predetermined direction of flow and adapted to form a substantially planar free jet of said fiber stock suspension;

at least one lip portion of said at least two hingedly interconnected lip portions defining an upstream lip portion situated adjacent said at least one further lip portion in an upstream direction as viewed in said predetermined direction of flow;

said at least one further lip portion and said upstream lip portion mutually defining a hinged connecting location;

said hinged connecting location being arranged in immediate proximity to said diaphragm;

adjustment means for pivotably adjusting said diaphragm about said hinged connecting location through an angle of inclination in relation to said oppositely situated lip member which is predetermined independently of the momentary position of said upstream lip portion;

said adjustment means further permitting adjusting said upstream lip portion independently of the momentary position of said diaphragm in relation to said stock distributor device;

said adjustment means comprising an elastically deformable wall element provided for at least one of the lip portions of the adjustable lip member; and said elastically deformable wall element being adjustable transversely to the direction of flow of the fiber stock suspension.

12. A headbox for a papermaking machine having a predetermined operating width, comprising:

an infeed means for a fiber stock suspension;

said fiber stock suspension having a predetermined direction of flow;

a stock distributor device rheologically connected to said infeed means;

a nozzle channel rheologically connected subsequent to said stock distributor device as viewed in said predetermined direction of flow;

a first lip member and a second lip member conjointly delimiting a slice opening extending over said predetermined operating width;

said nozzle channel being formed between said first lip member and said second lip member;

at least said first lip member comprising at least two hingedly interconnected lip portions arranged successively in said predetermined direction of flow;

said second lip member defining an oppositely situated lip member confronting said first lip member;

means for adjustably fixing said at least two hingedly interconnected lip portions relative to one another in a predetermined operative position thereof in relation to at least one of said oppositely situated lip member and said stock distributor device;

at least said first lip member defining an adjustable lip member;

said adjustable lip member comprising at least one lip portion of said at least two hingedly interconnected lip portions which is connected to said stock distributor device in correspondence with said predetermined direction of flow;

said adjustable lip member comprising at least one further lip portion of said at least two hingedly interconnected lip portions which at least partially delimits said slice opening;

said at least one further lip portion having a downstream end;

said at least one further lip portion being provided at said downstream end thereof with a diaphragm adjustable in relation to said oppositely situated lip member in a direction substantially transverse to said predetermined direction of flow and adapted to form a substantially planar free jet of said fiber stock suspension;

at least one lip portion of said at least two hingedly interconnected lip portions defining an upstream lip portion situated adjacent said at least one further lip portion in an upstream direction as viewed in said predetermined direction of flow;

said at least one further lip portion and said upstream lip portion mutually defining a hinged connecting location;

said hinged connecting location being arranged in immediate proximity to said diaphragm;

adjustment means for pivotably adjusting said diaphragm about said hinged connecting location through an angle of inclination in relation to said oppositely situated lip member which is predetermined independently of the momentary position of said upstream lip portion;

said adjustment means further permitting adjusting said upstream lip portion independently of the momentary position of said diaphragm in relation to said stock distributor device;

both of said first lip member and said second lip member being adjustable in position and defining two adjustable lip members;

each adjustable lip member of said two adjustable lip members comprising at least two successively arranged lip portions of said at least two hingedly interconnected lip portions; and said adjustment means comprising means for selectively adjusting said two adjustable lip members in relation to one another and in relation to a stock receiving gap of a twin-wire papermaking machine for controlling the deposition of the fiber stock suspension effluent from said slice opening into said stock receiving gap.

* * * * *